US008651646B2

(12) United States Patent
Govyadinov et al.

(10) Patent No.: US 8,651,646 B2
(45) Date of Patent: Feb. 18, 2014

(54) FLUID EJECTION ASSEMBLY WITH CIRCULATION PUMP

(75) Inventors: Alexander Govyadinov, Corvallis, OR (US); Pavel Kornilovich, Corvallis, OR (US); Erik D Torniainen, Redmond, WA (US); David P Markel, Albany, OR (US)

(73) Assignee: Hewlett-Packard Development Company, L.P., Houston, TX (US)

( * ) Notice: Subject to any disclaimer, the term of this patent is extended or adjusted under 35 U.S.C. 154(b) by 0 days.

(21) Appl. No.: 13/698,056

(22) PCT Filed: Oct. 28, 2010

(86) PCT No.: PCT/US2010/054458

§ 371 (c)(1),
(2), (4) Date: Nov. 15, 2012

(87) PCT Pub. No.: WO2012/008978

PCT Pub. Date: Jan. 19, 2012

(65) Prior Publication Data

US 2013/0057622 A1 Mar. 7, 2013

Related U.S. Application Data

(63) Continuation-in-part of application No. 12/833,984, filed on Jul. 11, 2010, now Pat. No. 8,540,355.

(51) Int. Cl.
*B41J 2/18* (2006.01)
*B41J 2/05* (2006.01)

(52) U.S. Cl.
USPC ..... 347/89; 347/65

(58) Field of Classification Search
None
See application file for complete search history.

(56) References Cited

U.S. PATENT DOCUMENTS

| | | | | |
|---|---|---|---|---|
| 5,818,485 | A | 10/1998 | Rezanka | |
| 6,227,660 | B1 | 5/2001 | McClelland et al. | |
| 6,244,694 | B1 * | 6/2001 | Weber et al. | 347/65 |
| 6,283,718 | B1 | 9/2001 | Prosperetti et al. | |
| 6,431,694 | B1 | 8/2002 | Ross | |
| 6,655,924 | B2 | 12/2003 | Ma | |
| 7,040,745 | B2 | 5/2006 | Kent | |
| 7,182,442 | B2 | 2/2007 | Sheinman | |
| 2008/0007604 | A1 | 1/2008 | Kang et al. | |
| 2010/0013887 | A1 | 1/2010 | Suh | |

FOREIGN PATENT DOCUMENTS

| | | |
|---|---|---|
| KR | 20080004095 | 1/2008 |

* cited by examiner

*Primary Examiner* — Geoffrey Mruk
(74) *Attorney, Agent, or Firm* — Nathan R. Rieth

(57) ABSTRACT

A fluid ejection assembly includes a fluid slot, and a group of uniformly spaced drop generators, where each drop generator is individually coupled to the fluid slot through a first end of a drop generator channel and to a connection channel at a second end of the drop generator channel. The fluid ejection assembly includes a pump disposed within a pump channel located between two drop generator channels, and is configured to circulate fluid from the fluid slot, into the connection channel through the pump channel, and back to the fluid slot through the drop generator channels.

12 Claims, 8 Drawing Sheets

FLUID EJECTION ASSEMBLY WITH CIRCULATION PUMP

BACKGROUND

Fluid ejection devices in inkjet printers provide drop-on-demand ejection of fluid drops. In general, inkjet printers print images by ejecting ink drops through a plurality of nozzles onto a print medium, such as a sheet of paper. The nozzles are typically arranged in one or more arrays, such that properly sequenced ejection of ink drops from the nozzles causes characters or other images to be printed on the print medium as the printhead and the print medium move relative to each other. In a specific example, a thermal inkjet printhead ejects drops from a nozzle by passing electrical current through a heating element to generate heat and vaporize a small portion of the fluid within a firing chamber. In another example, a piezoelectric inkjet printhead uses a piezoelectric material actuator to generate pressure pulses that force ink drops out of a nozzle.

Although inkjet printers provide high print quality at reasonable cost, continued improvement relies on overcoming various challenges that remain in their development. For example, air bubbles are a continuing problem in inkjet printheads. During printing, air from the ink is released and forms bubbles that can migrate from the firing chamber to other locations in the printhead and cause problems such as ink flow blockage, print quality degradation, partly full print cartridges appearing to be empty, and ink leaks. In addition, pigment-ink vehicle separation (PIVS) remains a problem when using pigment-based inks. Pigment-based inks are preferred in inkjet printing as they tend to be more durable and permanent than dye-based inks. However, during periods of storage or non-use, pigment particles can settle or crash out of the ink vehicle (i.e., PIVS) which can impede or completely block ink flow to the firing chambers and nozzles in the printhead. Other factors related to "decap" (i.e., uncapped nozzles exposed to ambient environments) such as evaporation of water or solvent can affect local ink properties such PIVS and viscous ink plug formation. Effects of decap can alter drop trajectories, velocities, shapes and colors, which have negative impacts on print quality.

BRIEF DESCRIPTION OF THE DRAWINGS

The present embodiments will now be described, by way of example, with reference to the accompanying drawings, in which.

DETAILED DESCRIPTION

Overview of Problem and Solution

Figure 1:
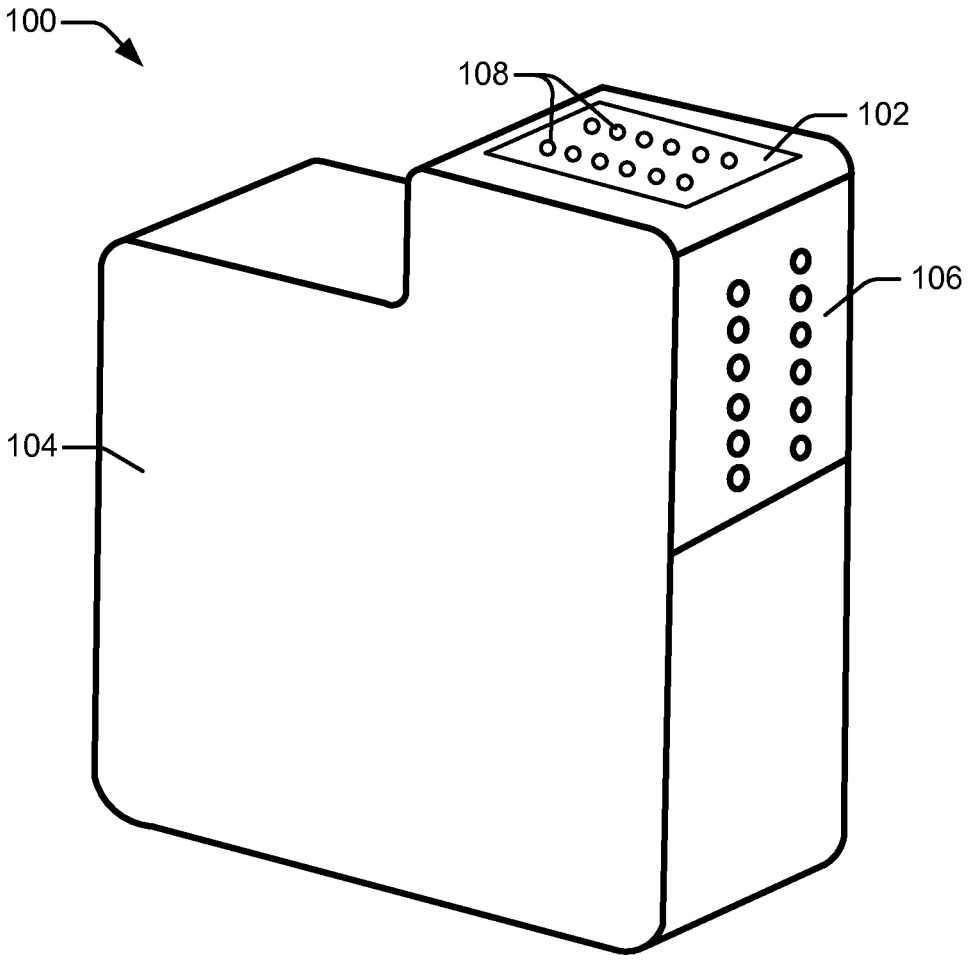
FIG. 1 shows an example of an inkjet pen suitable for incorporating a fluid ejection assembly, according to an embodiment.

As noted above, various challenges have yet to be overcome in the development of inkjet printing systems. For example, inkjet printheads used in such systems continue to have troubles with ink blockage and/or clogging. Previous solutions to this problem have primarily involved servicing the printheads before and after their use. For example, printheads are typically capped during non-use to prevent nozzles from clogging with dried ink. Prior to their use, nozzles are also primed by spitting ink through them. Drawbacks to these solutions include the inability to print immediately due to the servicing time, and an increase in the total cost of ownership due to the significant amount of ink consumed during servicing. Accordingly, decap performance including ink blockage and/or clogging in inkjet printing systems remains a fundamental problem that can degrade overall print quality and increase ownership costs, manufacturing costs, or both.

There are a number of causes for ink blockage or clogging in a printhead. One cause of ink blockage is an excess of air that accumulates as air bubbles in the printhead. When ink is exposed to air, such as while the ink is stored in an ink reservoir, additional air dissolves into the ink. The subsequent action of firing ink drops from the firing chamber of the printhead releases excess air from the ink which then accumulates as air bubbles. The bubbles move from the firing chamber to other areas of the printhead where they can block the flow of ink to the printhead and within the printhead.

Pigment-based inks can also cause ink blockage or clogging in printheads. Inkjet printing systems use pigment-based inks and dye-based inks, and while there are advantages and disadvantages with both types of ink, pigment-based inks are generally preferred. In dye-based inks the dye particles are dissolved in liquid so the ink tends to soak deeper into the paper. This makes dye-based ink less efficient and it can reduce the image quality as the ink bleeds at the edges of the image. Pigment-based inks, by contrast, consist of an ink vehicle and high concentrations of insoluble pigment particles coated with a dispersant that enables the particles to remain suspended in the ink vehicle. This helps pigment inks stay more on the surface of the paper rather than soaking into the paper. Pigment ink is therefore more efficient than dye ink because less ink is needed to create the same color intensity in a printed image. Pigment inks also tend to be more durable and permanent than dye inks as they smear less than dye inks when they encounter water.

One drawback with pigment-based inks, however, is that ink blockage can occur in the inkjet printhead due to factors such as prolonged storage and other environmental extremes which can result in poor out-of-box performance of inkjet pens. Inkjet pens have a printhead affixed at one end that is internally coupled to a supply of ink. The ink supply may be self-contained within the pen body or it may reside on the printer outside of the pen and be coupled to the printhead through the pen body. Over long periods of storage, gravitational effects on the large pigment particles and/or degradation of the dispersant can cause pigment settling or crashing, which is known as PIVS (pigment-ink vehicle separation). The settling or crashing of pigment particles can impede or completely block ink flow to the firing chambers and nozzles in the printhead which can result in poor out-of-box performance by the printhead and reduced image quality.

Other factors such as evaporation of water and solvent from the ink can also contribute to PIVS and/or increased ink viscosity and viscous plug formation, which can decrease decap performance and prevent immediate printing after periods of non-use.

Traditional methods of solving problems such as PIVS, and air and particulate accumulation include spitting of ink, mechanical and other external pumps, and ink mixing in thermal inkjet firing chambers. However, these solutions are typically cumbersome, expensive and only partially resolve the inkjet problems. More recent techniques for solving such problems involve micro-recirculation of ink through on-die ink-recirculation. One micro-recirculation technique applies sub-TOE (turn on energy) pulses to nozzle firing resistors to induce ink recirculation without firing (i.e., without turning on) the nozzle. This technique has some drawbacks including the risk of puddling ink onto the nozzle layer. Another micro-recirculation technique includes on-die ink-recirculation architectures that implement auxiliary micro-bubble pumps to improve nozzle reliability through ink recirculation. However, a drawback to this technique is that the auxiliary pumps create a trade-off between nozzle reliability and nozzle density/resolution because the pumps could otherwise be functioning as drop ejection elements.

Embodiments of the present disclosure improve on prior micro-recirculation techniques generally by placing an auxiliary pump resistor of irregular size and/or shape in between regularly or uniformly-spaced drop-ejecting thermal inkjet chambers of a fluid ejection assembly (i.e., printhead), thereby maintaining the nozzle density and original nozzle pitch of the fluid ejection assembly. Asymmetric positioning of the pump resistor within a recirculation channel creates an inertial mechanism that circulates fluid through the channel. Disclosed embodiments address significant issues with modern printhead IDS's (ink delivery systems) such as PIVS, air and particle accumulation, short decap time, and high ink consumption during servicing and priming, while maintaining the standard nozzle pitch and density/resolution.

In one example embodiment, a fluid ejection assembly includes a fluid slot and a group of uniformly spaced drop generators. Each drop generator is individually coupled to the fluid slot through a first end of a drop generator channel, and to a connection channel at a second end of the drop generator channel. A pump disposed within a pump channel is located between two drop generator channels and is configured to circulate fluid from the fluid slot, into the connection channel through the pump channel, and back to the fluid slot through the drop generator channels. In another embodiment, a method of circulating fluid in a fluid ejection assembly includes pumping fluid from a fluid slot through a pump channel that is located evenly between uniformly spaced drop generators. The fluid is circulated from the pump channel, through a connection channel, and back to the fluid slot through a drop generator channel that includes one of the uniformly spaced drop generators. In another embodiment, a fluid ejection device includes a fluid ejection assembly having ejection nozzles of a set nozzle density that are uniformly spaced along a fluid slot, and a fluid pump located evenly in the uniform space between two nozzles to circulate fluid from the fluid slot to the ejection nozzles and back to the fluid slot. The fluid ejection device also includes an electronic controller to control drop ejections and fluid circulation in the fluid ejection assembly.

ILLUSTRATIVE EMBODIMENTS

FIG. 1 shows an example of an inkjet pen 100 suitable for incorporating a fluid ejection assembly 102 as disclosed herein, according to an embodiment. In this embodiment, the fluid ejection assembly 102 is disclosed as a fluid drop jetting printhead 102. The inkjet pen 100 includes a pen cartridge body 104, printhead 102, and electrical contacts 106. Individual fluid drop generators 204 (e.g., see FIG. 2) within printhead 102 are energized by electrical signals provided at contacts 106 to eject drops of fluid from selected nozzles 108. The fluid can be any suitable fluid used in a printing process, such as various printable fluids, inks, pre-treatment compositions, fixers, and the like. In some examples, the fluid can be a fluid other than a printing fluid. The pen 100 may contain its own fluid supply within cartridge body 104, or it may receive fluid from an external supply (not shown) such as a fluid reservoir connected to pen 100 through a tube, for example. Pens 100 containing their own fluid supplies are generally disposable once the fluid supply is depleted.

Figure 2:
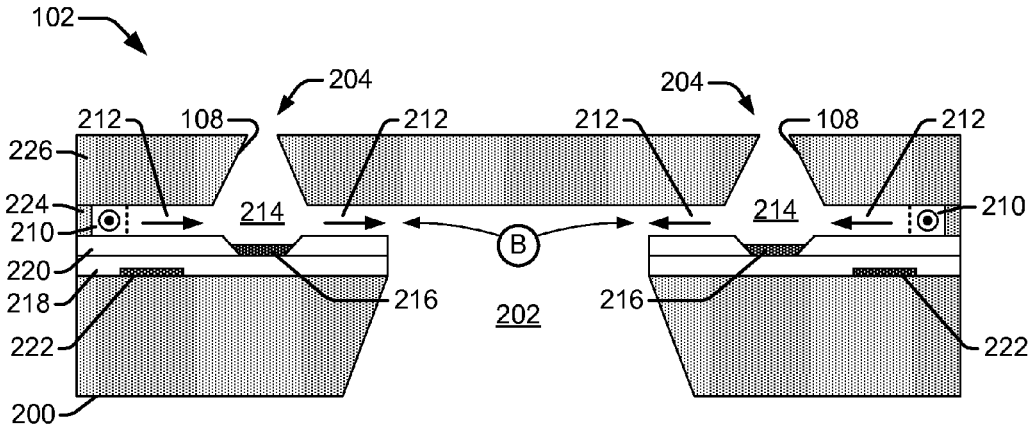
FIG. 2 shows a cross-sectional view of a fluid ejection assembly cut through a drop generator and drop generator channel, according to an embodiment.
Figure 3:
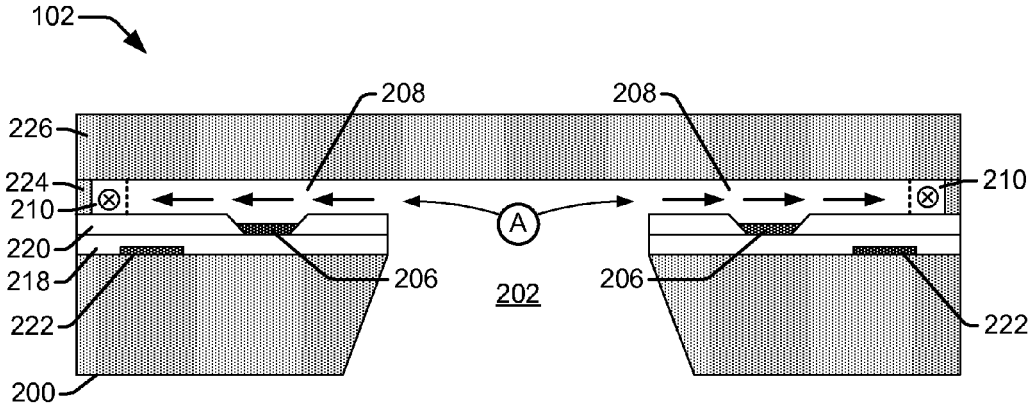
FIG. 3 shows a cross-sectional view of a fluid ejection assembly cut through a fluid pump and pump channel, according to an embodiment.

FIGS. 2 and 3 show cross-sectional views of a fluid ejection assembly 102 (printhead 102), according to an embodiment of the disclosure. FIG. 2 shows a cross-sectional view of the fluid ejection assembly 102 cut through a drop generator and drop generator channel, while FIG. 3 shows a cross-sectional view of the fluid ejection assembly 102 cut through a fluid pump and pump channel. Referring to FIGS. 2 and 3, the fluid ejection assembly 102 includes a substrate 200 with a fluid slot 202 formed therein. The fluid slot 202 is an elongated slot extending into the plane of FIG. 2 that is in fluid communication with a fluid supply (not shown), such as a fluid reservoir. In general, fluid from fluid slot 202 circulates through drop generators 204 (i.e., across chambers 214) based on flow induced by a fluid pump 206. As indicated by the black direction arrows in FIGS. 2 and 3, the pump 206 pumps fluid from the fluid slot 202 through a fluid recirculation channel. The recirculation channel begins at the fluid slot 202 and runs first through a pump channel 208 that contains the pump 206 (FIG. 3) located toward the beginning of the recirculation channel. The recirculation channel then continues through a connection channel 210 (FIGS. 2 and 3). The recirculation channel then runs through a drop generator channel 212 containing a drop generator 204 (FIG. 2), and is completed upon returning back to the fluid slot 202. Note that the direction of flow through connection channel 210 is indicated by a circle with a cross (flow going into the plane) in FIG. 3 and a circle with a dot (flow coming out of the plane) in FIG. 2. However, these flow directions are shown by way of example only, and in various pump configurations and depending on where a particular cross-sectional view cuts across the fluid ejection assembly 102, the directions may be reversed.

The exact location of the fluid pump 206 within the recirculation channel may vary somewhat, but in any case will be asymmetrically located with respect to the center point of the length of the recirculation channel. For example, the approximate center point of the recirculation channel is located somewhere in the connection channel 210 of FIGS. 2 and 3, since the recirculation channel begins in the fluid slot 202 at point "A" of FIG. 3, extends through the pump channel 208, the connection channel 210, and the drop generator channel 212, and then ends back in the fluid slot 202 at point "B" of FIG. 2. Therefore, the asymmetric location of the fluid pump 206 in the pump channel 208 creates a short side of the recirculation channel between the pump 206 and the fluid slot 202, and a long side of the recirculation channel that extends through the drop generator channel 212 back to the fluid slot 202. The asymmetric location of the fluid pump 206 at the short side of the recirculation channel is the basis for the fluidic diodicity within the recirculation channel which results in a net fluid flow in a forward direction toward the long side of the recirculation channel as indicated by the black direction arrows in FIGS. 2 and 3, as well as in FIGS. 4-8 discussed below.

Drop generators 204 can be uniformly arranged (e.g., equidistant apart from one another) on either side of the fluid slot 202 and along the length of the slot extending into the plane of FIG. 2. In addition, however, in some embodiments drop generators on either side of the slot 202 may also be differently sized and/or spaced. Each drop generator 204 includes a nozzle 108, an ejection chamber 214, and an ejection element 216 disposed within the chamber 214. Drop generators 204 (i.e., the nozzles 108, chambers 214, and ejection elements 216) are organized into groups referred to as primitives, wherein each primitive comprises a group of adjacent ejection elements 216 in which not more than one ejection element 216 is activated at a time. A primitive typically includes a group of twelve drop generators 204, but may include different numbers such as six, eight, ten, fourteen, sixteen, and so on.

Ejection element 216 can be any device capable of operating to eject fluid drops through a corresponding nozzle 108, such as a thermal resistor or piezoelectric actuator. In the illustrated embodiment, the ejection element 216 and the fluid pump 206 are thermal resistors formed of an oxide layer 218 on a top surface of the substrate 200 and a thin film stack 220 applied on top of the oxide layer 218. The thin film stack 220 generally includes an oxide layer, a metal layer defining the ejection element 216 and pump 206, conductive traces, and a passivation layer. Although the fluid pump 206 is discussed as a thermal resistor element, in other embodiments it can be any of various types of pumping elements that may be suitably deployed within a pump channel 208 of a fluid ejection assembly 102. For example, in different embodiments fluid pump 206 might be implemented as a piezoelectric actuator pump, an electrostatic pump, an electro hydrodynamic pump, etc.

Also formed on the top surface of the substrate 200 is additional integrated circuitry 222 for selectively activating each ejection element 216, and for activating fluid pumps 206. The additional circuitry 222 includes a drive transistor such as a field-effect transistor (FET), for example, associated with each ejection element 216. While each ejection element 216 has a dedicated drive transistor to enable individual activation of each ejection element 216, each pump 206 typically does not have a dedicated drive transistor because pumps 206 do not generally need to be activated individually. Rather, a single drive transistor typically powers a group of pumps 206 simultaneously. The fluid ejection assembly 102 also includes a chamber layer 224 having walls and chambers 214 that separate the substrate 200 from a nozzle layer 226 having nozzles 108.

Figure 4:
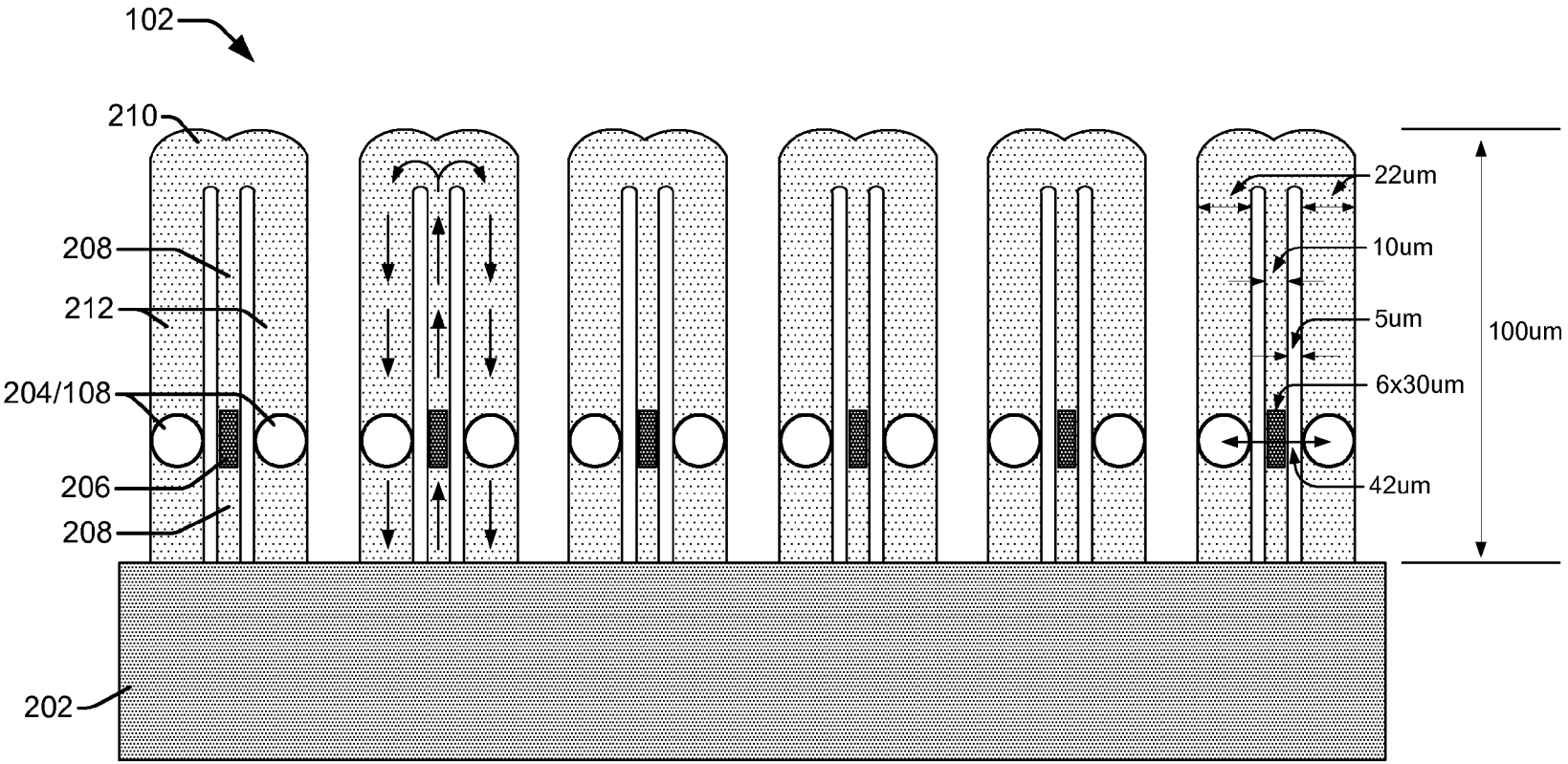
FIG. 4 shows a partial bottom view of a fluid ejection assembly having an example arrangement of drop generators along a side of a fluid slot, according to an embodiment.

FIG. 4 is a partial bottom view of a fluid ejection assembly 102 showing an example arrangement of drop generators 204 along the side of fluid slot 202, according to an embodiment of the disclosure. The arrangement of drop generators 204 (nozzles 108) represents one primitive having twelve nozzles 108 and six small pump resistors 206. Thus, in this embodiment there is one pump resistor 206 per every two nozzles 108 (i.e., per every two ejection elements 216). As noted above, each ejection element 216 within a drop generator 204 has a dedicated drive transistor to enable individual activation of the ejection element 216, while a single drive transistor typically powers a group of pumps 206 simultaneously. Thus, a single drive transistor may power all six of the pumps 206, or two drive transistors may each power three of the pumps 206, and so on. Accordingly, the drop generator arrangement shown in FIG. 4 may implement thirteen drive transistors, fourteen drive transistors, etc. The fluid recirculation channel indicated by the black direction arrows as discussed above can be clearly observed in FIG. 4. Fluid from fluid slot 202 circulates through drop generators 204 based on flow induced by a fluid pump 206. Pump 206 pumps fluid from the fluid slot 202 through a fluid recirculation channel. The fluid recirculation channel begins generally at the fluid slot 202 and runs first through pump channel 208. The recirculation channel then continues through a connection channel 210. The recirculation channel then runs through one or more drop generator channels 212, each containing a drop generator 204. The recirculation channel is completed at the slot-end of the drop generator channel 212 as the recirculation channel returns back to the fluid slot 202.

As shown in FIG. 4, drop generators 204 (nozzles 108) are evenly arranged, or are an equal distance apart from one another, along the length of the fluid slot 202. In one embodiment, the density of the nozzles 108 in an inkjet pen 100 is 600 NPCI (nozzles per column inch), which indicates that there are 600 nozzles per inch arranged in a column along one side of the slot 202. Because there is a column on either side of the fluid slot 202, 600 NPCI inkjet pens 100 are generally considered to be 1200 pixel pens, or 1200 DPI (dots per inch) pens. FIG. 4 shows example dimensions that enable the micro-recirculation channels in such an embodiment. Thus, in a 600 NPCI inkjet pen 100, the nozzle pitch (i.e., center to center distance between nozzles) for the uniformly spaced nozzles 108 can be approximately 42 microns. With nozzle chambers 214 and drop generator channels 212 that are 22 microns across, this enables a 10 micron wide pump channel 208 to fit evenly in between the drop generator channels 212 at 5 micron stand offs without interfering with the uniformity or density of the nozzles 108. The shape and size of the pump resistor 206 is shown as being 6×30 microns, but these dimensions can be adjusted to achieve desired pumping effects and to fit the pump 206 within different pump channel 208 sizes. Although the arrangement of micro-recirculation channels and pumps in the disclosed embodiments is illustrated and described as being applicable to inkjet pens 100 having a 600 NPCI (1200 DPI) nozzle density, it is noted that the placement of such channels and pumps evenly between uniformly spaced drop generators 204 (nozzles 108) is contemplated for inkjet pens 100 having higher nozzle densities, such as 1200 NPCI (2400 DPI), for example. It will be understood to those skilled in the art that such arrangements as applied to higher density pens are a function of ever-improving micro-fabrication techniques.

Figure 5:
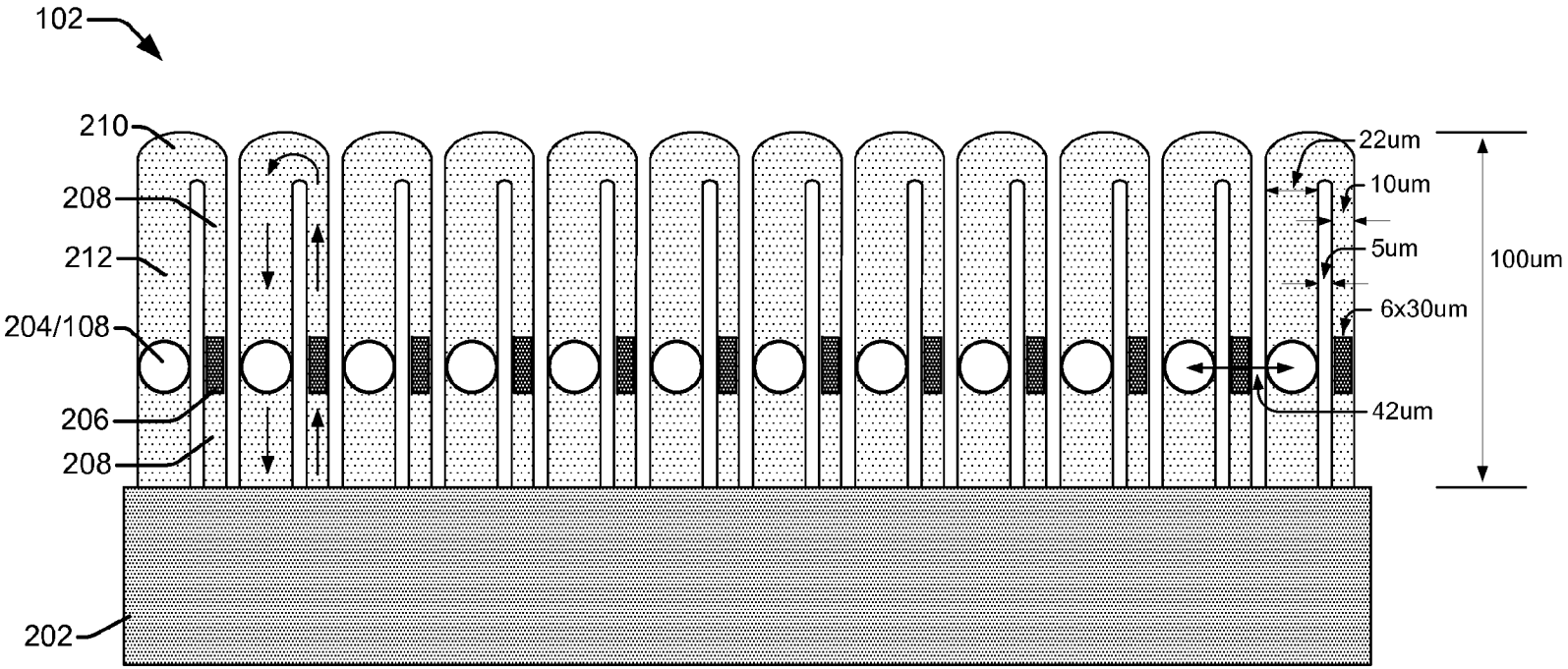
FIG. 5 shows a partial bottom view of a fluid ejection assembly having another example arrangement of drop generators along a side of a fluid slot, according to an embodiment.
Figure 6:
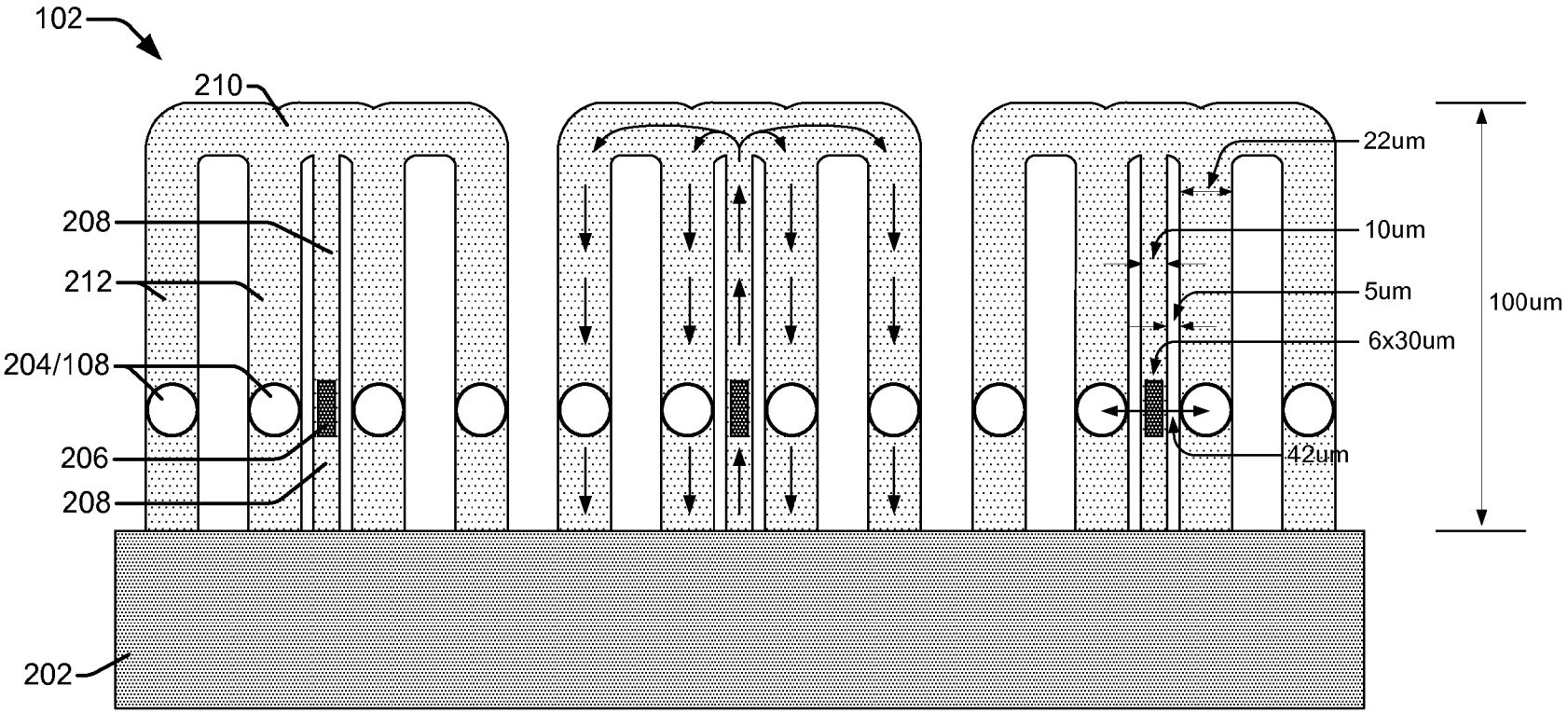
FIG. 6 shows a partial bottom view of a fluid ejection assembly having another example arrangement of drop generators along a side of a fluid slot, according to an embodiment.
Figure 7:
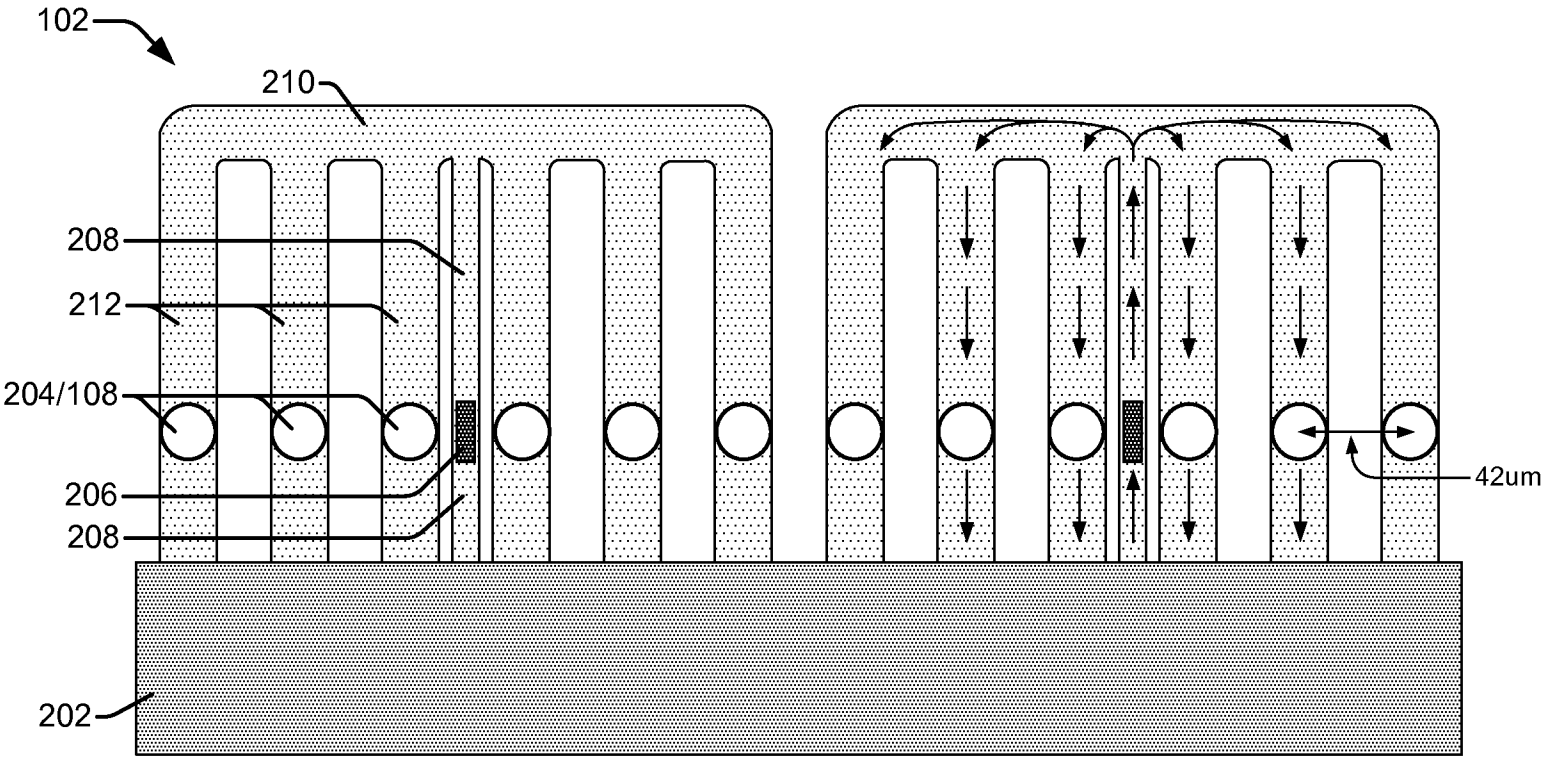
FIG. 7 shows a partial bottom view of a fluid ejection assembly having another example arrangement of drop generators along a side of a fluid slot, according to an embodiment.

FIGS. 5-7 show partial bottom views of fluid ejection assemblies 102 having various example arrangements of drop generators 204 along the sides of fluid slots 202, according to embodiments of the disclosure. In each embodiment, the arrangement of drop generators 204 (nozzles 108) represents one primitive having twelve nozzles 108. However, the number of pump resistors 206 and their arrangement among the twelve nozzles 108 vary between the different embodiments.

The embodiment of FIG. 5 includes one pump resistor 206 for each nozzle 108 or ejection element 216. The embodiment of FIG. 6 includes one pump resistor 206 for every four nozzles 108 or ejection elements 216. The embodiment of FIG. 7 includes one pump resistor 206 for every six nozzles 108 or ejection elements 216. While each ejection element 216 has a dedicated drive transistor (FET) to enable individual activation of the ejection element 216, a single drive transistor may power the entire group of pumps 206 simultaneously, or more than one drive transistor may each power a subset of the pumps 206 simultaneously in each of the embodiments of FIGS. 5-7. Accordingly, the drop generator arrangements shown in of FIGS. 5-7 may implement as few as thirteen drive transistors, or in an extreme case, as many as twenty four drive transistors. In the latter case, FETs of different size (i.e., taking up different amounts of space on the substrate) can be used. For example, smaller FETs can be used for the pumps 206, while larger FETs can be used for the ejection elements 216. In each embodiment shown in FIGS. 5-7, fluid from fluid slot 202 circulates through drop generators 204 along a recirculation channel based on flow induced by a fluid pump 206. A fluid recirculation channel is indicated by the black direction arrows, and it begins generally at the fluid slot 202. Each recirculation channel runs first through a pump channel 208 and then continues through a connection channel 210. The recirculation channel then runs through a drop generator channel 212, each channel 212 containing a drop generator 204. Each recirculation channel is completed at the slot-end of a drop generator channel 212 as the recirculation channel returns back to the fluid slot 202.

In each embodiment shown in FIGS. 5-7, drop generators 204 (nozzles 108) are evenly arranged, or are an equal distance apart from one another, along the length of the fluid slot 202. In one example implementation, the density of the nozzles 108 in an inkjet pen 100 is 600 NPCI (nozzles per column inch), which indicates that there are 600 nozzles per inch arranged in a column along one side of the slot 202. The standard nozzle pitch (i.e., center to center distance between nozzles) in a 600 NPCI inkjet pen 100 for uniformly spaced nozzles 108 is approximately 42 microns. With nozzle chambers 214 and drop generator channels 212 that are 22 microns across, 10 micron wide pump channels 208 can fit evenly in between the drop generator channels 212 at 5 micron stand offs without interfering with the uniformity or density of the nozzles 108. The embodiments shown in FIGS. 5-7 illustrate several possible arrangements of drop generators 204 (nozzles 108) and pump resistors 206 that are evenly spaced such that they enable fluid recirculation without interfering with the uniformity or density of the nozzles 108.

Figure 8:
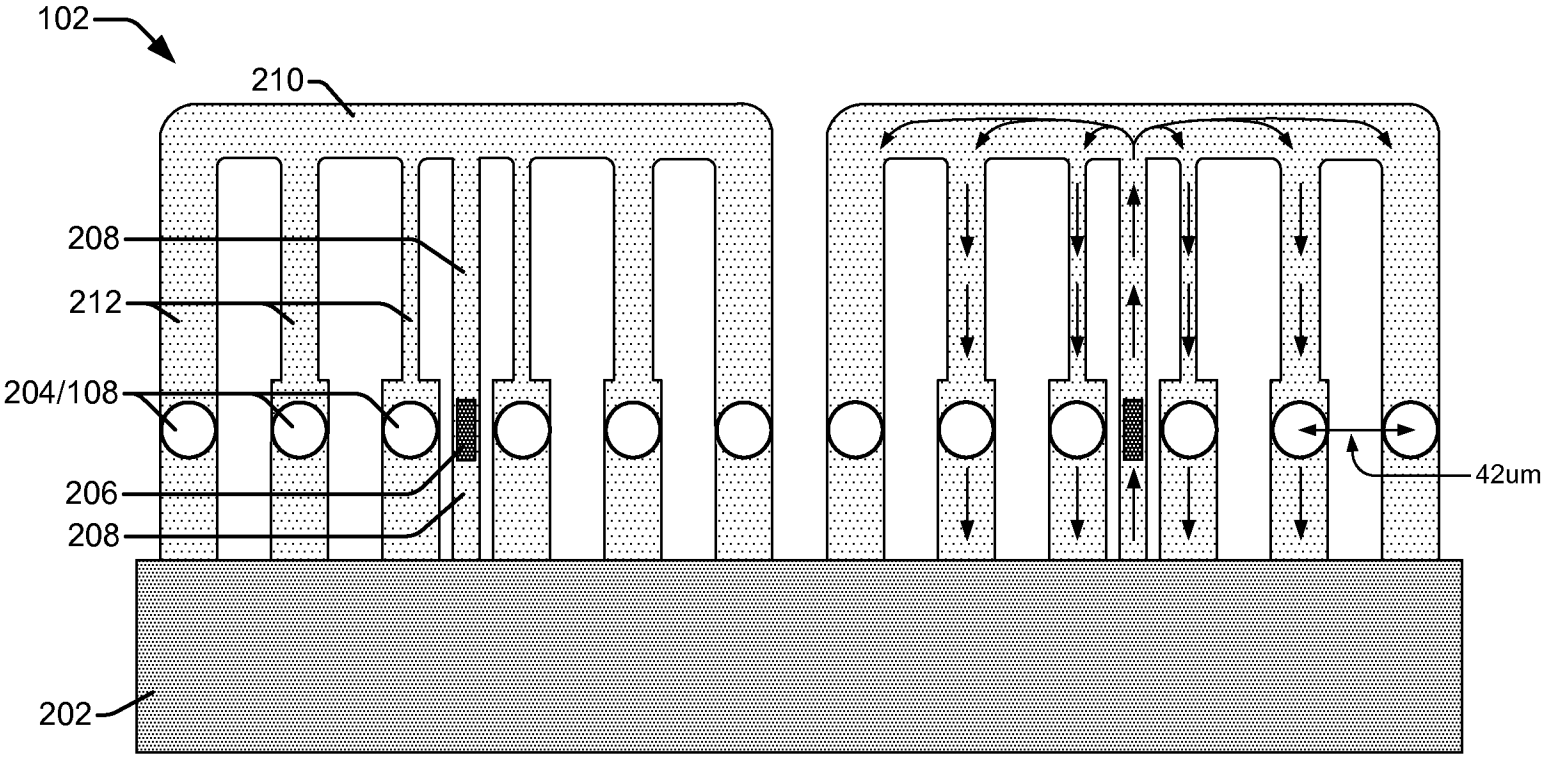
FIG. 8 shows a partial bottom view of a fluid ejection assembly with an example arrangement of drop generators that have variable drop generator channel widths, according to an embodiment.

FIG. 8 shows a partial bottom view of a fluid ejection assembly 102 with an example arrangement of drop generators 204 that have variable drop generator channel 212 widths (i.e., variable nozzle channel widths), according to an embodiment of the disclosure. The drop generators 204 and pumps 206 in this embodiment are arranged in a similar manner as in the FIG. 7 embodiment discussed above. Thus, the arrangement of drop generators 204 (nozzles 108) represents a primitive having twelve nozzles 108, and there is one pump resistor 206 for every six nozzles 108 or ejection elements 216. Furthermore, the density of the nozzles 108 is 600 NPCI and the nozzle pitch is approximately 42 microns as in the previous examples.

In general, as a pump 206 recirculates fluid through a number of drop generator channels 212, such as in FIG. 7, the drop generator channel 212 closest to the pump channel 208 receives the greatest fluid flow, while the drop generator channel 212 farthest away from the pump channel 208 receives the lowest fluid flow. Thus, fluid recirculation may not be uniform through all the drop generators 208. Such a fluid flow differential can result in variations in the quality of drops generated between nozzles 108 that are closer to the pump 206 and nozzles 108 that are farther away from the pump 206. The example embodiment shown in FIG. 8 remedies this potential recirculation flow differential by varying the widths of the drop generator channels 212 based on their distances from the pump channel 208. More specifically, the drop generator channel widths increase as the drop generator channels 212 get farther away from the pump channel 208, and they decrease as the drop generator channels 212 get closer to the pump channel 208. The narrower widths of the drop generator channels 212 nearest the pump channel 208 restrict the fluid flow through the closer drop generator channels 212, while the wider widths of the drop generator channels 212 farther away from the pump channel 208 increase the fluid flow through the more distant drop generator channels 212. Accordingly, the increasingly narrow widths of the drop generator channels 212 as the channels 212 get nearer to the pump channel 208 tends to create a more uniform flow of fluid circulation through all the drop generator channels 212.

Generally, such flow equalization can be achieved by various means which together control fluidic resistance of the recirculation channels to be proportional to the channel length and reciprocal to the channel cross-section. The fluidic resistance of the recirculation channel extending generally from the drop ejection element 216 to the recirculation pump 206 can be increased in order to decrease the recirculation flow rate, and decreased to achieve increased flow rates. Fluidic resistance within recirculation channels can be decreased by decreasing channel lengths and/or by increasing the channel cross-section. The channel cross-section can be controlled using both channel width and channel depth. Thus, fluidic resistance can be decreased by increasing channel widths and/or increasing channel depths.

A method of circulating fluid through a fluid ejection assembly will now be described. The method is in accordance with an embodiment of the disclosure, and is associated with the embodiments of a fluid ejection assembly 102 discussed above with respect to the illustrations in FIGS. 1-8.

The method includes pumping fluid from a fluid slot through a pump channel that is located between uniformly spaced drop generators. The pump channel may be located evenly between the uniformly spaced drop generators. The pumping can include activating a thermal resistor pump (or some other type of pump mechanism) located asymmetrically within a recirculation channel, where the recirculation channel includes a pump channel, a connection channel, and a drop generator channel. Activating a thermal resistor pump can include driving a plurality of thermal resistor pumps simultaneously with a single driver transistor.

The method further includes circulating the fluid from the pump channel, through a connection channel, and back to the fluid slot through a drop generator channel that includes one of the uniformly spaced drop generators. The circulating can include circulating the fluid from the pump channel, through the connection channel, and back to the fluid slot through a plurality of drop generator channels that each include a uniformly spaced drop generator. The circulating can include circulating the fluid from the pump channel, through the connection channel, and back to the fluid slot through a plurality of drop generator channels of varying fluidic resistances. The varying fluidic resistances in drop generator channels can be achieved by varying the channel lengths (i.e., longer channels have greater fluidic resistance, and shorter channels have lesser fluid resistance) and the channel cross-sections (greater cross-sections have lesser fluidic resistance and smaller cross-sections have greater fluidic resistance). Channel cross-sections can be adjusted with channel width and channel depth.

Figure 9:
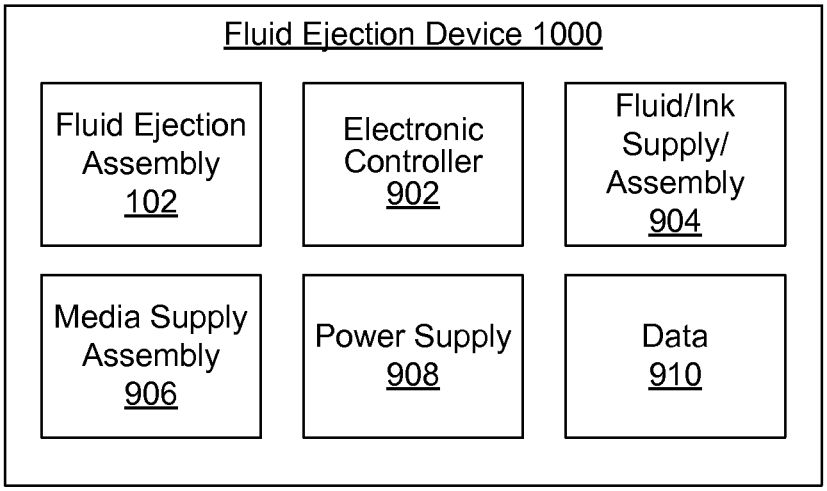
FIG. 9 shows a block diagram of a basic fluid ejection device, according to an embodiment.

FIG. 9 shows a block diagram of a basic fluid ejection device, according to an embodiment of the disclosure. The fluid ejection device 900 includes an electronic controller 902 and a fluid ejection assembly 102. Fluid ejection assembly 102 can be any embodiment of a fluid ejection assembly 102 described, illustrated and/or contemplated by the present disclosure. Electronic controller 902 typically includes a processor, firmware, and other electronics for communicating with and controlling fluid ejection assembly 102 to eject fluid droplets in a precise manner.

In one embodiment, fluid ejection device 900 is an inkjet printing device. As such, fluid ejection device 900 may also include a fluid/ink supply and assembly 904 to supply fluid to fluid ejection assembly 102, a media transport assembly 906 to provide media for receiving patterns of ejected fluid droplets, and a power supply 908. In general, electronic controller 902 receives data 910 from a host system, such as a computer. The data 910 represents, for example, a document and/or file to be printed and forms a print job that includes one or more print job commands and/or command parameters. From the data 910, electronic controller 902 defines a pattern of drops to eject which form characters, symbols, and/or other graphics or images.

What is claimed is:

1. A fluid ejection assembly comprising:

a fluid slot;

a group of uniformly spaced drop generators, each drop generator individually coupled to the fluid slot through a first end of a drop generator channel and to a connection channel at a second end of the drop generator channel;

a pump disposed within a pump channel located between and parallel to two drop generator channels, the pump configured to circulate fluid from the fluid slot, into the connection channel through the pump channel, and back to the fluid slot through the drop generator channels.

2. A fluid ejection assembly as in claim 1, wherein the pump is asymmetrically located within a recirculation channel that includes the pump channel, the connection channel, and a drop generator channel.

3. A fluid ejection assembly as in claim 1, further comprising a plurality of pumps disposed within respective pump channels, each pump channel coupled through a respective connection channel to a plurality of drop generator channels, each pump to circulate fluid from the fluid slot, through respective pump and connection channels, and back to the fluid slot through respective pluralities of drop generator channels.

4. A fluid ejection assembly as in claim 3, further comprising:

an ejection drive transistor to drive a single ejection element associated with each drop generator; and a pump drive transistor to drive the plurality of pumps simultaneously.

5. A fluid ejection assembly as in claim 4, further comprising a separate pump drive transistor to drive each pump.

6. A fluid ejection assembly as in claim 1, wherein a cross-sectional dimension of a drop generator channel farther away from the pump channel is greater than a cross-sectional dimension of a drop generator channel closer to the pump channel, thereby causing a lesser fluidic resistance in the drop generator channel farther away from the pump channel.

7. A fluid ejection assembly as in claim 1, further comprising a recirculation channel, the recirculation channel comprising:

the pump channel;

the connection channel; and a drop generator channel.

8. A fluid ejection assembly of claim 1, wherein the pump channel is indirectly connected fluidically to each drop generator channel.

9. A fluid ejection assembly of claim 1, wherein the pump channel is directly connected fluidically to the connection channel, and wherein each drop generator channel is directly connected fluidically to the connection channel.

10. A fluid ejection assembly of claim 9, wherein the pump channel is indirectly connected fluidically to each drop generator channel through the connection channel.

11. A fluid ejection device, comprising:

a fluid ejection assembly having ejection nozzles of a set nozzle density that are uniformly spaced along a fluid slot, and a fluid pump located in the uniform space between two nozzles to circulate fluid from the fluid slot to the ejection nozzles and back to the fluid slot via a pump channel parallel to two drop generator channels, each drop generator channel individually coupling the fluid slot to a different one of the nozzles at a first end thereof; and, an electronic controller to control drop ejections and fluid circulation in the fluid ejection assembly.

12. A fluid ejection device as in claim 11, further comprising:

a recirculation channel having the fluid pump located asymmetrically toward the beginning of the channel.

* * * * *